US005764197A

United States Patent [19]

Tsuru et al.

[11] Patent Number: 5,764,197

[45] Date of Patent: Jun. 9, 1998

[54] CHIP ANTENNA

[75] Inventors: Teruhisa Tsuru, Kameoka; Harufumi Mandai, Takatsuki; Koji Shiroki; Kenji Asakura, both of Shiga-ken, all of Japan

[73] Assignee: Murata Manufacturing Co., Ltd., Japan

[21] Appl. No.: 667,978

[22] Filed: Jun. 19, 1996

[30] Foreign Application Priority Data

Jun. 20, 1995 [JP] Japan ..... 7-153427

[51] Int. Cl.[6] ..... H01Q 1/24; H01Q 1/36

[52] U.S. Cl. ..... 343/895; 343/702; 343/873

[58] Field of Search ..... 343/895, 702, 343/787, 788, 872, 873, 866, 741; H01Q 1/24, 1/36

[56] References Cited

U.S. PATENT DOCUMENTS 2,472,106 6/1949 Hansen ..... 343/727
5,136,303 8/1992 Cho et al. ..... 343/718
5,250,923 10/1993 Ushiro et al. ..... 336/83
5,341,148 8/1994 Walter et al. ..... 343/895
5,412,392 5/1995 Tsunekawa ..... 343/702
5,541,610 7/1996 Imanishi et al. ..... 343/895

*Primary Examiner*—Hoanganh T. Le
*Attorney, Agent, or Firm*—Ostrolenk, Faber, Gerb & Soffen, LLP

[57] ABSTRACT

A chip antenna which provides a high gain and large band width and which makes it possible to achieve a reduction in the size of the chip antenna. The chip antenna has a dielectric base which is formed as a rectangular parallelepiped containing a spirally wound conductor whose winding axis is perpendicular to the longitudinal dimension of the dielectric base and parallel to the mounting surface. The configuration of the winding cross section S, which is perpendicular to the winding axis of the conductor, is a rectangle whose longitudinal vertical dimension is H and whose horizontal dimension is W. One end of the conductor is led out to the surface of the dielectric base to form a feeding end that is connected to a feeding terminal for applying a signal to the conductor, and the other end thereof forms a free end within the dielectric base.

7 Claims, 2 Drawing Sheets

FIG.1
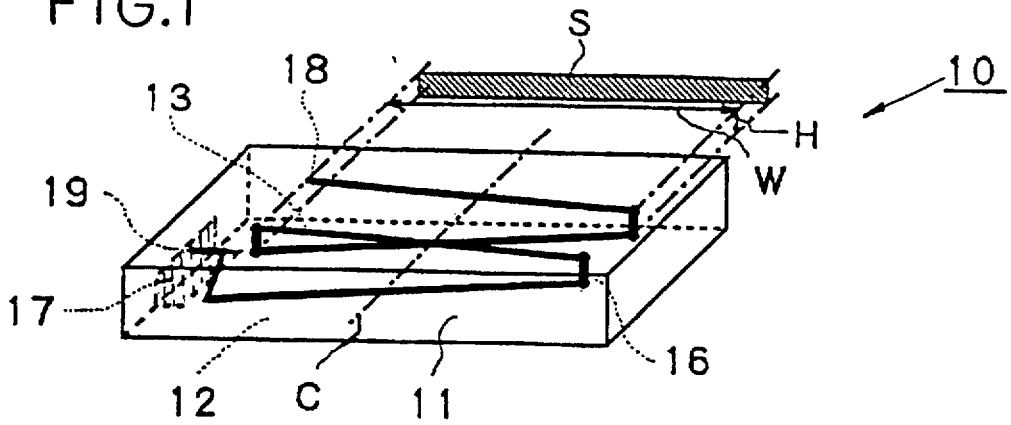
FIG. 2
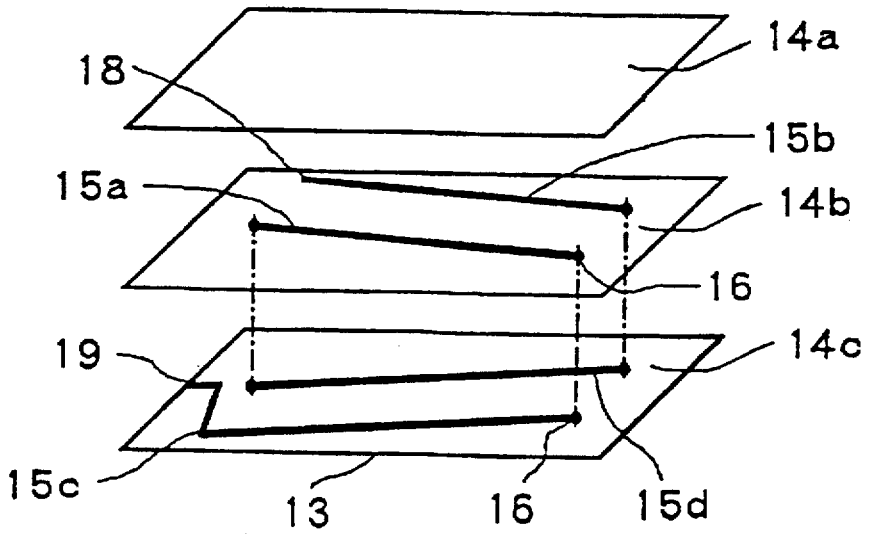
FIG. 3 *PRIOR ART*
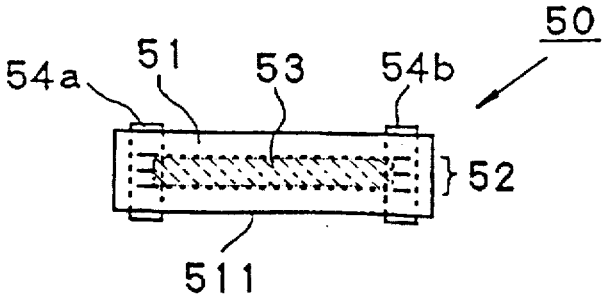

CHIP ANTENNA

CROSS-REFERENCE TO RELATED APPLICATION

This application is related to Ser. No. 08/664,139, filed Jun. 14, 1996, entitled RADIO COMMUNICATION EQUIPMENT, the disclosures of which are incorporated by reference.

BACKGROUND OF THE INVENTION

1. Field of the Invention

The present invention relates to a chip antenna and, in particular, to a chip antenna for use in mobile communications or in a LAN (local area network), for example.

2. Description of Related Art

FIG. 3 shows a sectional view of a conventional chip antenna 50. Numeral 51 indicates an insulator; numeral 52 indicates a coil; numeral 53 indicates a magnetic material; and numerals 54*a* and 54*b* indicate external connection terminals. The lower surface of the insulator 51 is formed as a mounting surface 511, and the winding axis of the coil 52 is perpendicular to the mounting surface 511.

The process for producing the conventional chip antenna 50 will be described with reference to FIGS. 4(*a*) through 4(*f*).

First, as shown in FIG. 4(*a*), an insulator layer 55 is formed such that one main surface thereof constitutes the mounting surface 511 of the insulator 51, and a substantially L-shaped conductor pattern 56 having a leading end S is printed on the other main surface of the insulator layer 55. A magnetic material pattern of high permeability 57 is printed on the central portion of the insulator layer 51. Then, as shown in FIG. 4(*b*), a substantially U-shaped non-magnetic insulator layer 58 covering the right-hand half of the conductor pattern 56 and the right-hand half of the insulator layer 55 (excluding the magnetic material pattern 57) is printed. Next, as shown in FIG. 4(*c*), a substantially L-shaped conductor pattern 59 is printed such that one end thereof is superimposed on an end portion of the conductor pattern 56, a magnetic material pattern 60 being similarly printed on the magnetic material pattern 57.

Then, as shown in FIG. 4(*d*), a substantially U-shaped non-magnetic insulator layer 61 is printed on the left-hand half, excluding the magnetic material pattern 60. Then, the processes of FIGS. 4(*a*) through 4(*d*) are repeated a predetermined number of times, except that the leading end S is not formed again.

When a predetermined number of turns has been reached, a substantially U-shaped conductor pattern 62 is printed such that one end thereof is superimposed on an end portion of the conductor pattern 59, as shown in FIG. 4(*e*), and the other end thereof is exposed at the end of the non-magnetic insulator layer 61 to form a leading end F. In this way, an open-magnetic-circuit type coil 52 having leading ends S and F is formed by the conductor patterns 56 and 62.

Finally, as shown in FIG. 4(*f*), an insulator layer 63 is printed on the entire surface to thereby terminate the lamination. In this way, the insulator 51 is formed by the insulator layers 55, 58, 61 and 63; the magnetic material 53 is formed by the magnetic material patterns 57 and 60; and the coil 52 is formed by the conductor patterns 56, 59 and 62. This laminate is fired at a predetermined temperature and for a predetermined period of time to obtain an integrated sintered body. After that, the external connection terminals 54*a* and 54*b* are attached to the leading ends S and F and baked to thereby obtain the chip antenna 50.

In this chip antenna 50, an amorphous magnetic metal (having a relative magnetic permeability of $10^4$ to $10^5$) is used for the magnetic material patterns 57 and 60 to thereby increase the inductance of the chip antenna 50, thereby reducing the resonance frequency.

The above-described conventional chip antenna has a problem in that the number of turns is rather large due to the fact that the winding axis of the coil 52 is perpendicular to the mounting surface. The large number of turns results in the height of the chip antenna being rather large.

Further, the line length of the coil is approximately equal to [(wavelength of the resonance frequency)/10], which is rather small as compared with the length [(wavelength of the resonance frequency)/4] of a dipole antenna, so that the electrical volume is rather small, resulting in a rather poor gain.

Further, at a high frequency of 100 MHz or more, the loss due to the magnetic material layer is large, which makes it impossible for the antenna to be used.

SUMMARY OF THE INVENTION

The present invention has been made with a view toward eliminating these problems in the prior art. It is accordingly an object of the present invention to provide a chip antenna which is of high gain and wide band width and which allows a reduction in height.

To achieve the above object, there is provided, in accordance with an embodiment of the present invention, a chip antenna comprising: a dielectric base having the shape of a rectangular parallelepiped and having a mounting surface; a spirally wound conductor provided on the surface of or inside the dielectric base; and a feeding terminal provided on the surface of the dielectric base and connected for applying a signal to the conductor, wherein the winding axis of the conductor is perpendicular to the longitudinal dimension of the dielectric base and parallel to the mounting surface.

In such a chip antenna, since the winding axis of the conductor is perpendicular to the longitudinal dimension of the dielectric base, and parallel to the mounting surface thereof, it is possible to increase the outer circumference of the winding cross section of the conductor without increasing the size of the chip antenna.

Other features and advantages of the present invention will become apparent from the following description of the invention which refers to the accompanying drawings.

BRIEF DESCRIPTION OF THE DRAWINGS

FIG. 1 is a perspective view of a chip antenna according to an embodiment of the present invention;

FIG. 2 is an exploded perspective view of the chip antenna of FIG. 1;

FIG. 3 is a sectional view showing a conventional chip antenna; and

DESCRIPTION OF A PREFERRED EMBODIMENT

Figure 4A:
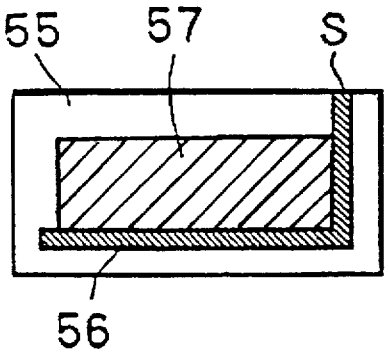
FIG. 4(a) PRIOR ART
FIGS. 4(*a*) through 4(*f*) are schematic plan views for illustrating the process for producing the chip antenna of FIG. 3.
Figure 4B:
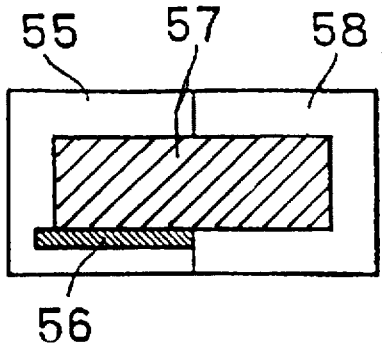
FIG. 4(b) PRIOR ART
Figure 4C:
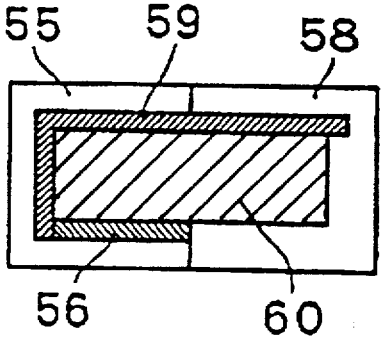
FIG. 4(c) PRIOR ART
Figure 4D:
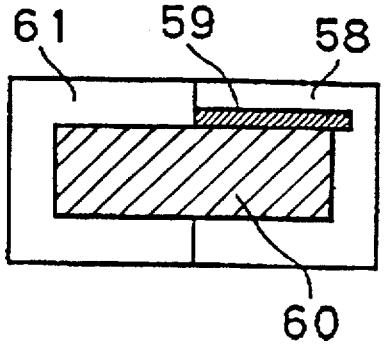
FIG. 4(d) PRIOR ART
Figure 4E:
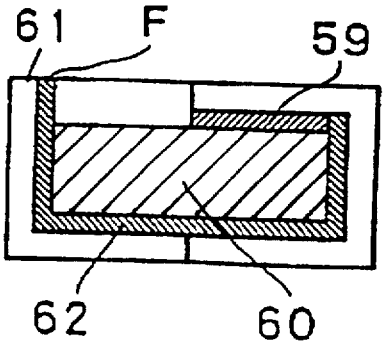
FIG. 4(e) PRIOR ART
Figure 4F:
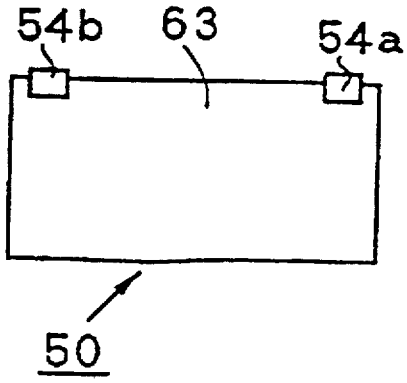
FIG. 4(f) PRIOR ART

FIG. 1 and 2 are a perspective view and an exploded perspective view of a chip antenna according to an embodiment of the present invention.

A chip antenna 10 has a dielectric base 11 formed as a rectangular parallelepiped and contains a conductor 13 which is spirally wound, with its winding axis C being perpendicular to a longitudinal dimension of the dielectric base 11 (from left to right in FIG. 1) and parallel to the mounting surface 12. The configuration of the winding cross section S, which is perpendicular to the winding axis C of the conductor 13, is a rectangular whose vertical and horizontal dimensions are H and W, respectively.

The dielectric base 11 is formed by stacking together rectangular dielectric sheets 14*a*, 14*b* and 14*c* which are formed of a ceramic mixture whose main components are barium oxide, aluminum oxide, silica, etc., or a resin such as a Teflon (trademark) resin, or a mixture of a ceramic and a resin. Of these, the dielectric sheets 14*b* and 14*c* have on their surfaces linear conductive patterns 15*a*, 15*b*, 15*c* and 15*d* of copper or a copper alloy or the like and formed by printing, evaporation, gluing or plating. Further, on the dielectric sheets 14*b* and 14*c*, via holes 16, formed so as to extend in the thickness direction, are provided. By stacking the dielectric sheets 14*a*, 14*b* and 14*c* together and connecting the conductive patterns 15*a*, 15*b*, 15*c* and 15*d* through the via holes 16, the spirally wound conductor 13 is formed.

One end of the conductor 13 (one end of the conductor pattern 15*c*) is led to an outside surface of the dielectric base 11 to form a feeding end 19, which is connected to a feeding terminal 17 for applying a signal to the conductor 13, and the other end of the conductor (one end of the conductive pattern 15*b*) forms a free end 18 within the dielectric base 11.

As described above, in the above-described embodiment, the winding axis C of the conductor 13 is perpendicular to the longitudinal dimension of the dielectric base 11, which is formed as a rectangular parallelepiped, so that it is possible to enlarge the outer circumference (2×(H+W)) of the winding cross section S of the conductor 13. Thus, while a line length of the conductor 13 may be the same as that in the prior art, it is possible to reduce the number of turns and the inductance component. Since it is possible to reduce the number of turns, the size of the chip antenna is reduced. Further, since it is possible to reduce the inductance component, it is possible for a given inductance, which may be the same as that in the prior art, to enlarge the line length, to thereby achieve an improvement in gain and to enlarge the band width. Thus, the disclosed chip antenna proves to be effective as an antenna for use at a high frequency which is 1 GHz or more.

Further, since the winding axis C of the conductor 13 is parallel to the mounting surface 12 of the dielectric base 11, which is formed as a rectangular parallelepiped, it is possible to reduce the height of the chip antenna even when the number of turns and the line length are increased.

The configuration of the winding cross section S of the conductor 13 is not limited to being a rectangle. It may also be circular, oval or semicircular in shape and furthermore may have portions which are at least partially straight.

Further, while the present invention has been described with reference to an example in which the dielectric base is formed by stacking a plurality of dielectric sheets together, it is also possible to form the dielectric base by using, for example, a single dielectric body in the form of a block. In this case, the conductor is formed in the single block-like dielectric body by first winding the conductor around the surface of the single block-like dielectric body and then covering the conductor with another dielectric body.

Further, while the present invention has been described with reference to an example in which the conductor is formed within the dielectric base, it is also possible to wind the conductor pattern around the surface of the dielectric base to thereby form the conductor. Further, it is also possible to provide a spiral groove in the surface of the dielectric base, and wind a line material such as a plating line or an enamel line along the groove to thereby form the conductor.

Further, while the present invention has been described with reference to an example in which the feeding terminal is positioned perpendicular to the winding axis, this is not absolutely necessary in carrying out the present invention.

Although the present invention has been described in relation to a particular embodiment thereof, many other variations and modifications and other uses will become apparent to those skilled in the art. Therefore, the present invention is not limited by the specific disclosure herein.

What is claimed is:

1. A chip antenna comprising:

a dielectric substrate having a mounting surface, a longitudinal dimension, a transverse dimension which is smaller than said longitudinal dimension, and a thickness dimension which is smaller than said transverse dimension; a spirally wound conductor attached to said dielectric substrate; and a terminal connected to said conductor for applying a signal to said conductor, wherein the winding axis of said conductor is perpendicular to said longitudinal dimension of said dielectric substrate and parallel to said mounting surface.

2. The chip antenna of claim 1, wherein said dielectric substrate comprises at least two stacked layers wherein respective portions of said spirally wound conductor are disposed on each of said at least two stacked layers.

3. The chip antenna of claim 2, wherein a stacking axis of said layers is perpendicular to said winding axis of said conductor.

4. The chip antenna of claim 1, wherein said spirally wound conductor is disposed within said dielectric substrate.

5. The chip antenna of claim 1, wherein said terminal is located at least partially on said mounting surface.

6. The chip antenna of claim 5, wherein said terminal is located at least partially adjacent to said mounting surface.

7. The chip antenna of claim 1, wherein said terminal is located at least partially adjacent to said mounting surface.

* * * * *